US006776732B2

(12) United States Patent
Parkinson et al.

(10) Patent No.: US 6,776,732 B2
(45) Date of Patent: Aug. 17, 2004

(54) SIMULATED TENNIS BALL TRAJECTORY & DELIVERY SYSTEM

(76) Inventors: Paul Parkinson, 2655 Gulfstream La., Ft. Launderdale, FL (US) 33312; Peter Daniel, 1525 SW. 17th St., Ft. Lauderdale, FL (US) 33312

( * ) Notice: Subject to any disclaimer, the term of this patent is extended or adjusted under 35 U.S.C. 154(b) by 0 days.

(21) Appl. No.: 10/180,584

(22) Filed: Jun. 26, 2002

(65) Prior Publication Data

US 2002/0165048 A1 Nov. 7, 2002

Related U.S. Application Data

(63) Continuation-in-part of application No. 09/765,046, filed on Jan. 19, 2001, now abandoned.

(51) Int. Cl.[7] ..... A63B 69/00; A63B 67/00; F41A 19/00

(52) U.S. Cl. ..... 473/431; 473/459; 273/445; 124/54; 124/34

(58) Field of Search ..... 124/6, 78, 31, 124/34; 473/422, 431, 433, 436, 447, 132, 134, 135, 136; 273/371, 381, 405, 402, 317.1, 317.4, 382, 383, 379

(56) References Cited

U.S. PATENT DOCUMENTS

| | | | | | |
|---|---|---|---|---|---|
| 2,087,575 | A | * | 7/1937 | Littell et al. | 473/436 |
| 3,858,880 | A | * | 1/1975 | Graves | 473/459 |
| 3,989,245 | A | * | 11/1976 | Augustine et al. | 473/431 |
| 3,989,246 | A | * | 11/1976 | Brown et al. | 473/431 |
| 4,021,036 | A | * | 5/1977 | Nelson et al. | 473/459 |
| 4,070,018 | A | * | 1/1978 | Hodges | 473/462 |
| 4,108,432 | A | * | 8/1978 | Clark et al. | 473/431 |
| 4,702,475 | A | * | 10/1987 | Elstein et al. | 273/445 |
| 4,861,027 | A | * | 8/1989 | Thaxton | 473/431 |
| 4,863,175 | A | * | 9/1989 | Ricks et al. | 273/342 |
| 5,261,659 | A | * | 11/1993 | Tierney | 473/457 |
| 5,464,208 | A | * | 11/1995 | Pierce | 473/451 |
| 5,487,540 | A | * | 1/1996 | Bixler et al. | 473/436 |
| 5,599,017 | A | * | 2/1997 | Bixler et al. | 473/436 |
| 5,776,018 | A | * | 7/1998 | Simpson et al. | 473/433 |
| 5,816,953 | A | * | 10/1998 | Cleveland | 473/459 |
| 6,135,456 | A | * | 10/2000 | Cooper | 273/371 |

FOREIGN PATENT DOCUMENTS

| | | |
|---|---|---|
| WO | 90/12621 | * 11/1990 |

* cited by examiner

*Primary Examiner*—Stephen P. Garbe
*Assistant Examiner*—Mitra Aryanpour

(57) ABSTRACT

A tennis training simulation system is disclosed that improves both reaction time and ground stroke techniques within a limited physical training environment. This training system combines simulated service of a tennis ball from a service line over a virtual net, and delivery of real tennis ball to an awaiting tennis student. In the system of this invention, the tennis ball delivery system includes an automatic tennis ball machine equipped with an array of lights or LED's that simulate the service of a tennis ball from a service line, a simulated trajectory of the tennis ball over a virtual net, and a simulated first bounce of a tennis ball coupled immediately thereafter with real in-flight delivery of an actual tennis ball to an awaiting tennis student.

11 Claims, 3 Drawing Sheets

SIMULATED TENNIS BALL TRAJECTORY & DELIVERY SYSTEM

CROSS-REFERENCE TO RELATED APPLICATIONS

This application is a Continuation-In-Part of U.S. application Ser. No. 09/765,046, filed Jan. 19, 2001 now abandoned.

BACKGROUND OF THE INVENTION

1. Field of the Invention

This invention relates to a device and to a system. More specifically, this invention relates to a tennis ball machine wherein the tennis ball delivery and trajectory are simulated by a series of lights or indicators mounted on the console of the ball machine. The sequencing of illumination of this series of indicators simulates the ball trajectory from the time the ball is served (leaves the racket of the opponent), and crosses the net, and bounces to the player.

2. Background of Invention

Automatic ball hurling machines have been used in various sports for a number of years. Baseball throwing machines have been designed which simulate various types of pitches (e.g. curve ball, slider, fast ball, etc.), by simulating the speed and spin imparted to the baseball. Tennis ball hurling machines operate in a similar fashion and typically deliver a ball from the opposite side of the net to an awaiting player. In the typical tennis environment, the receiving player thus follows the ball trajectory from the time the ball leaves the ball machine and travels over the net, to position himself to strike the ball so as to permit striking the ball and returning it over the net. The tennis ball machine can be pre-set or programmed in accordance with a varied ball delivery routine. For example, the ball machine can provide for an oscillating delivery, to allow for practice of a forehand and backhand stroke. Similarly, some ball machines can apply top-spin to the delivered ball, thereby making the ball more difficult to return. In each circumstance, the tennis ball machine contemplates use of a full size tennis court to accommodate the delivery and return of the tennis ball. In order to reduce the area (land) required to conduct such practice, various simulators have been developed to accommodate the more limited space constraints in urban and home environments.

The following US patents are representative of the simulators that have been conceived to address some of the limitations of traditional tennis training environments.

U.S. Pat. No. 3,989,245 (to Augustine, Jr., et al. issued Nov. 2, 1976) describes a tennis environment and system that utilizes a practice environment this is somewhat smaller than a full size tennis court. The system associated with the Augustine environment simulates the service of a tennis ball, and the return from the player on the opposite side of the net. The Augustine system also provides for recovery of the ball for re-use by the ball machine.

U.S. Pat. No. 4,702,475 (to Elstein et al, issued Oct. 27, 475) describes a device and system for accelerated reaction training of a tennis student utilizing an array of lights positioned within the field of view of the student to prompt a different reaction or movement by the student to a simulated trajectory of a tennis ball. More specifically, each of the lights within the array is pre-programmed to simulate a reaction drill and a "virtual" ground stroke, and thereby prompt a student to react to a different tennis ball trajectory relative to a service position on the opposite side of the tennis net. The Elstein et al, system is described independent of an automated ball service machine; and, it is not clear if the Elstein et al, system can be adapted to a realistic training environment wherein the student is required to return service.

In each of the representative systems described above, the physical environment and the simulation of the delivery of the tennis ball, generally contemplates an essentially full size tennis court environment. Notwithstanding the relative advantages of each, both require a relatively large practice environment, and separate and distinct practice drills to improve reaction time and ground stroke technique. Accordingly, there continues to exist the need to combine the advantages of each, and to yet afford such advantages within the urban and home environment settings that are constrained by the physical limitation inherent in such environments.

OBJECTS OF THE INVENTION

It is the object of this invention to remedy the above as well as related deficiencies in the prior art.

More specifically, it is the principal object of this invention to provide a tennis training simulation system that improves both reaction time and ground stroke techniques within a limited physical training environment.

It is another object of this invention to provide a tennis training simulation system that improves both reaction time and ground stroke techniques by providing both visual and real simulation of the service of a tennis ball from the service line to the student awaiting the tennis ball delivery.

It is yet another object of this invention to provide a tennis training simulation system that improves both reaction time and ground stroke techniques by providing actual delivery of a tennis ball to a student, on the first bounce, over a simulated net.

SUMMARY OF THE INVENTION

The above and related objects are achieved by providing a tennis training simulation system that improves both reaction time and ground stroke techniques within a limited physical training environment, by combining simulated service of a tennis ball from a service line over a virtual net, and the actual/real delivery of a real tennis ball to an awaiting tennis student. In the system and method of this invention, the tennis ball delivery system includes an automatic tennis ball machine equipped with an array of lights or LED's that simulate the service of a tennis ball from a service line, a simulated trajectory of the tennis ball over a virtual net, a simulated first bounce to an awaiting tennis student, and immediately thereafter, delivery of a real tennis ball, directly from an automatic tennis ball machine, to the tennis student.

In one of the preferred embodiments of this invention, the array of lights or LED's on the tennis ball machine can be pre-programmed to a timed sequence to simulate the speed of the simulated tennis service. Because of the simulation of the service and ball trajectory from the service line over the net, the tennis training simulation system of this invention only requires a limited area in which to operate, and generally, less than half of a the size of a tennis court. Accordingly, the tennis training simulation system can be utilized in confined urban environments, specifically, indoors and on private property residences that are lacking tennis facilities.

DETAILED DESCRIPTION OF THE INVENTION INCLUDING PREFERRED EMBODIMENTS

Figure 1:
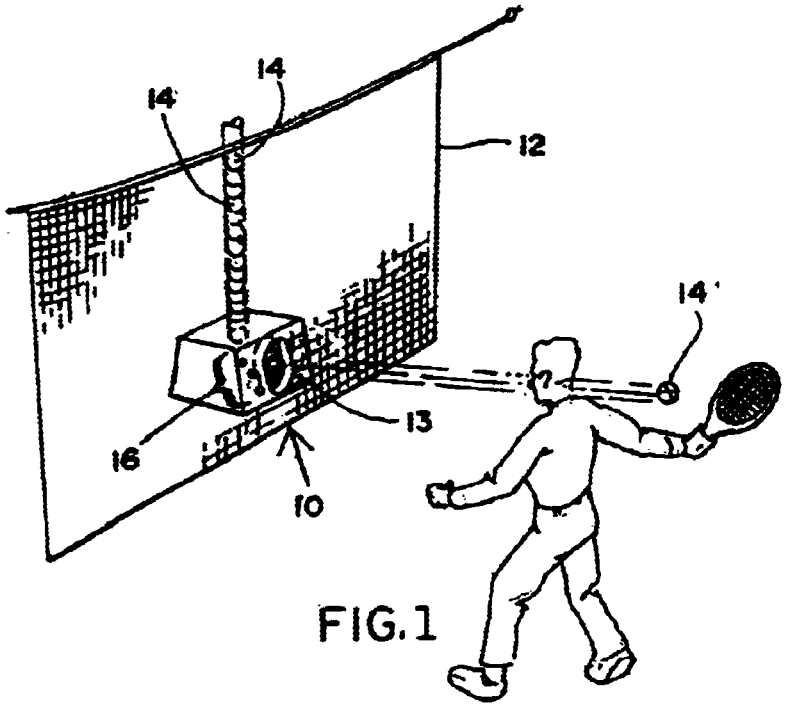
FIG. 1 is a perspective view of the tennis training simulation system of this invention.

The Figures which accompany this application, and referenced herein, depict representative assemblies of this invention. In the embodiments of this invention illustrated in these FIGS, such FIGS include components in common and thus, such common components are assigned the same reference numerals for ease of understanding and continuity of explanation.

FIG. 1 depicts the tennis training simulation system in use in an environment having limited area (e.g. two car garage). In the depiction of the system of this invention illustrated in FIG. 1, the tennis training simulation system comprises a ball machine console (10), and a protective mesh or netting (12) between the console (10) and the tennis student to protect the ball machine from the impact from a tennis ball (14) resulting from a return volley by the student and to capture the returned ball after impact by the student. A hole or vent (13) is disposed within the net (12) to permit the ball (14) to be delivered to the student. The ball machine console (10) includes a series or array of lights or LED's (16) arranged on the forward facing panel (18) of the console (10). Each of the individual lights or LED's in the array (16) correspond to the simulation of an opponent's tennis service/hit (16') and trajectory of the serve/hit over the net (16") from the service line. More specifically, the first light (16') in the series of the array of lights or LED's is simulative of the initiation of this service sequence. Thereafter, a finite delay occurs before the second in the series of the array of lights or LED's is illuminated. This second light (16") in the series is simulative of the passage of the ball over the net. Thereafter, a finite delay occurs before the third light (16'") in the series of the array of lights or LED's is illuminated. The last in the series of the lights or LED's (16'") simulates the bounce of the service of the serve/hit on the tennis trainee's side of the net, and corresponds with the ejection of a tennis ball (14) from the ball console (10). The speed and flight of the ball (14) from the console (10) is characteristic of a tennis ball bounce on the receiving side of the net. The flight of the ball from the ball machine can preferably be pre-programmed to correspond to simulate different ball speeds and ball trajectory.

Figure 2A:
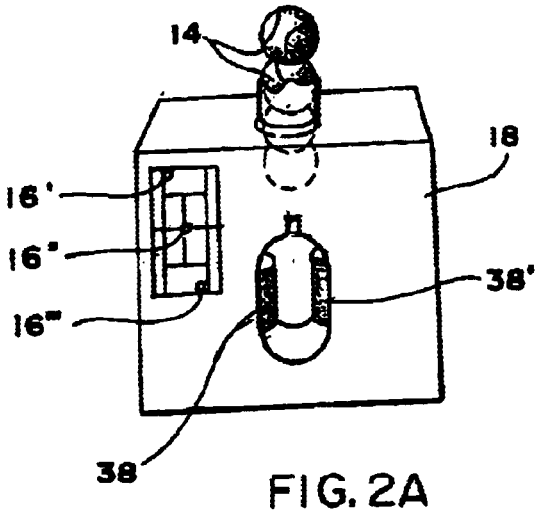
FIG. 2A is a photographic depiction of a prototype incorporating the tennis training simulation system of this invention.
Figure 2B:
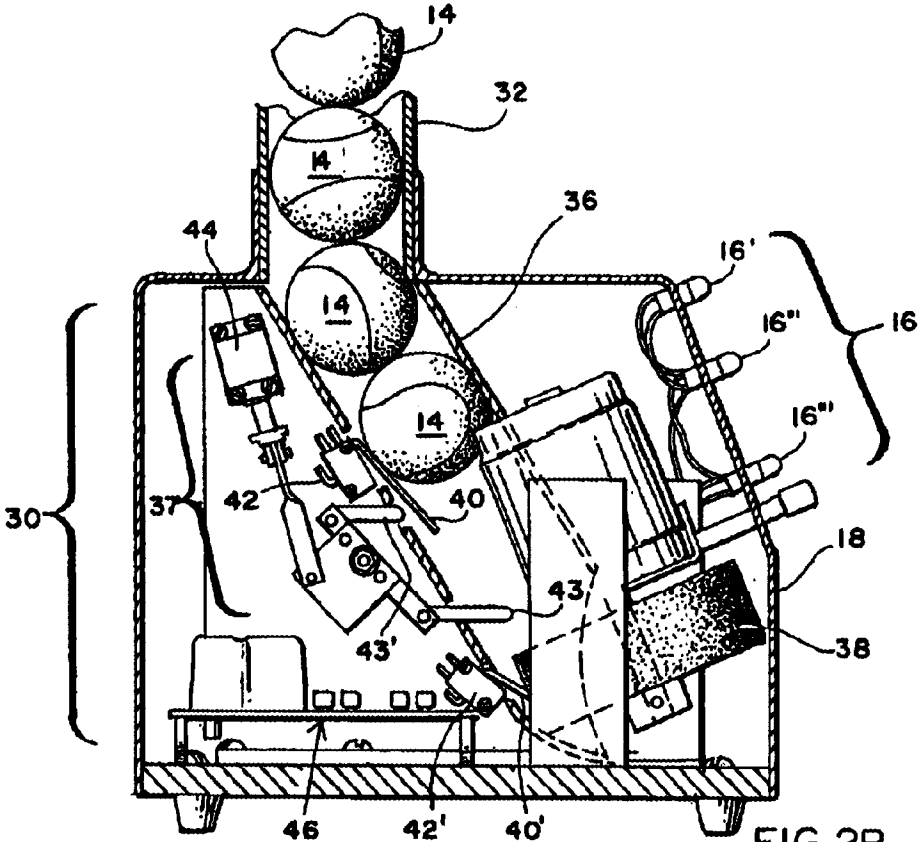
FIG. 2B an exploded view of the ball machine console of the tennis training simulation system depicted in FIGS. 1 & 2A; and, FIG. 3 is an isolated schematic of the tennis training simulation system in relation to the ball machine mechanism of FIG. 2.

In the embodiment of the invention depicted in FIGS. 1, 2A and 2B, the console (10) includes a housing (30), a transparent feed tube (32) extending vertically from the top of the console and a three light array (16) on the forward panel (18) of the console which faces the tennis student. The transparent feed tube (32) is filled with tennis balls (14) prior to use; and, the tennis balls (14) thereafter automatically feed into the console (10) where each is propelled, one at a time, by an impeller mechanism (34) within the console, to an awaiting student. This gravity feeding of the tennis balls from the feed tube (32) into a ball chute (36) within the console, positions the most interior of the tennis balls (14) proximate to the impeller mechanism (34). This impeller mechanism (34) comprises a pair of synchronous, counter-rotating high speed wheels (38, 38').

In practice, movement of a ball (14) down the ball chute (36) is controlled by gating means (37) associated with the chute. More specifically, once the system is turned on, after a suitable delay, the timing mechanism causes the first of the lights or LED's within the array to turn on simulating the serve. Thereafter, the second of the lights or LED's with the array turns on simulating the trajectory of the tennis ball over the net. Then, the third light or LED turns on simulating the bounce of the ball on the student's side of the net. Lastly, the gating means (37) releases the tennis ball (14) to permit its gravity feeding from the ball chute (36) into the impeller mechanism (34). As above noted, at each stage of this simulation, a light or LED on the console is illuminated to alert the tennis student as to the approximate virtual position of the tennis ball before it is fed into the impeller mechanism.

Figure 3:
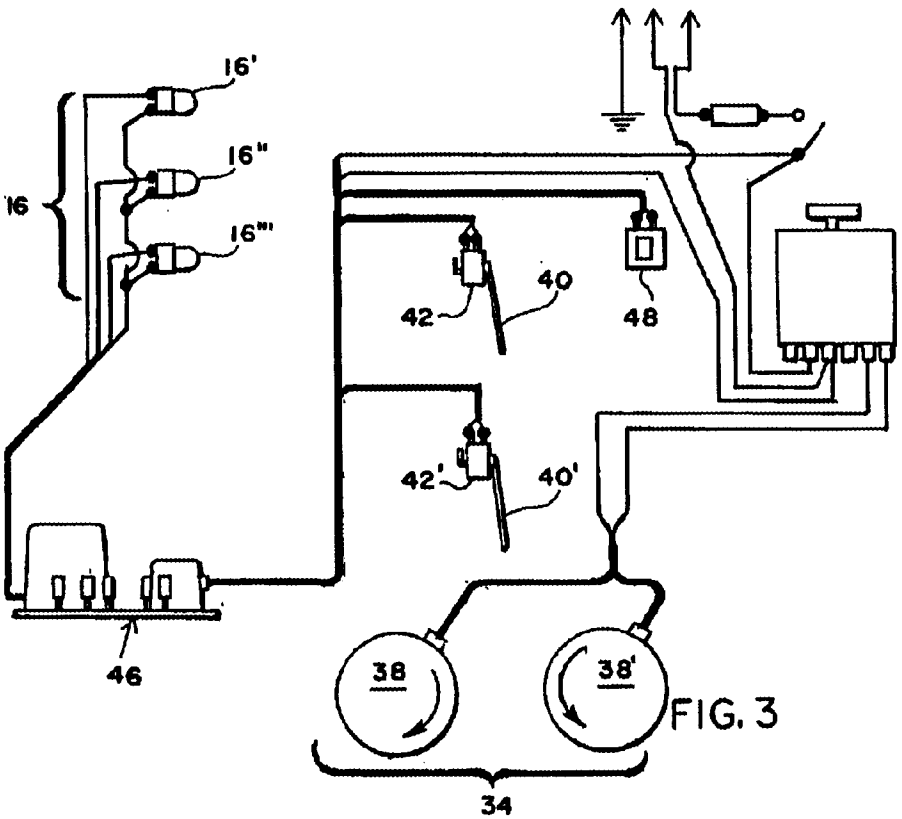

As more fully illustrated in FIGS. 2B and 3, the ball chute (36), angled from the feed tube (32), feeds the tennis balls (14) forward from the vertical feeder tube (32); and, the gating means (37) associated with the chute, incrementally releases one ball at a time, for each simulation sequence. The timing of the release of the balls at the end of the ball chute is microprocessor controlled, and the duration of the interval between each simulation sequence governed by a pre-programmed simulation routine of the training system.

In the specific embodiment of the invention illustrated in FIG. 2B, switch (42) has a lever (40) that either one or two tennis balls can keep depressed as the balls drop. This switch (42), when depressed, allows the timing sequence to operate, and also shuts down the timing sequence after all balls are ejected. When the feed tube (32) is inserted onto the console (10), balls (14) contained with the tube are gravity fed and are retained by ball chute gate (43). When the start time switch (48) is turned on, the sequence begins. The lights (16) are sequentially illuminated as heretofore disclosed. Illumination of the first light (16') informs the player to prepare to get into a hitting position. As the third light (16'") is illuminated, the solenoid (44) is engaged. The solenoid (44) withdraws the ball chute gate (43) of the gating means (37) thereby releasing the bottom-most ball (14), and at the same time, thrusts the ball impedance gate (43') into the chute thereby preventing other balls from being released.

The released ball trips switch (42') which breaks the circuit and starts the sequence over. The tripped switch (42') also releases the solenoid (44), allowing the ball chute gate (43) to be thrust into the chute and at the same time causes the ball impedance gate to withdraw so that the next ball (14) can advance to the ball chute gate (43) in preparation for the next sequence. The counter-rotating wheels (38) of the impeller (34) can be adjusted to deliver the tennis ball at different speeds and/or when rotated asynchronously to put "English" or spin on the projected ball to enhance the difficulty of its return of service.

FIG. 3 further isolates the mechanical levers (40, 40') and switches (42, 42') of the chute gate means (37), the timing circuitry (46), and the impeller ensemble (34), which includes counter-rotating motors of the impeller wheels, and rheostat speed control for the motors. In operation, the console is turned on by activation of a start timer switch (48) which, after a pre-programmed delay, initiates the sequence of events which energizes the ball supply switch (42) along the ball chute (36), and, initiates the process of the sequential illumination of the lights in the array (16) on the forward panel (18) of the console (10). Once the tennis ball (14) has been advanced down the chute into the gate means (37), the system counts down for ejection/delivery of a tennis ball from the ball chute with each of the lights within the array illuminating, in turn. At the conclusion of this sequence, a tennis ball is delivered from the ball chute to the awaiting tennis student as if it had been served, traveled over the net and bounced onto the receiving side of the net. The sequence repeated so long as the tennis balls are supplied to the ball chute within the console.

In the preferred embodiments of this invention, the pre-programmed information permits variation in the timing and delivery of the tennis ball from the ball machine console. The mechanism depicted in FIGS. 2A and 2B can be further modified to permit oscillation of the ball chute, and thereby both backhand and forehand delivery of the tennis ball.

The invention as above described is provided as illustrative of a number of the preferred embodiments of this invention. Thus, this description is neither intended, nor should it be construed as, to delineate the scope of this invention, which has been reserved for the claims that follow.

What is claimed is:

1. A tennis training simulation system comprising:

An automated tennis ball delivery machine which includes a console having means for displaying the virtual flight path of a tennis ball comprising an array of visible indicators in a defined sequence relative to one another and positioned on a forward facing panel of said console, A ball chute within said console for feeding of tennis balls, one at a time, to an impeller means for bounceless delivery of a single tennis ball from said ball chute to an awaiting tennis player, said ball chute being further provided with gating means for control of passage of a tennis ball long said ball chute and activation means, associated with said gate, to open and close said gate, Timer means for coordinated ejection of a tennis ball with the last of said visible indicators, and Impeller means for delivery of a tennis ball from said console to an awaiting tennis player upon illumination of the last of said indicators within said indicator array.

2. The tennis training simulation system of claim 1, wherein said array of indicators comprises a series of lights or LED's that can be sequentially activated in response to a timed pulse.

3. The tennis training simulation system of claim 1, wherein said impeller means comprises a pair of counter-rotating wheels positioned at the end of the ball chute.

4. The tennis training simulation system of claim 1, wherein said console further includes means for supplying tennis balls to said ball chute, said ball supply means including means for visual observation of the contents of ball supply means.

5. The tennis training simulation system of claim 1, wherein said timer means includes a programmable module and means for selection from among training system routines stored within said module.

6. The tennis training simulation system of claim 1, wherein said gating means including a solenoid activated reciprocating member for release of a tennis ball, one at a time, along said ball chute.

7. The tennis training simulation system of claim 1, wherein said console further includes at least two visible indicators to display the virtual flight path of said tennis ball.

8. The tennis training simulation system of claim 1, wherein said console comprises three visible indicators to display the virtual flight path of said tennis ball.

9. A tennis training simulation system comprising:

An automated ten a ball delivery machine which includes a console having means for displaying the virtual flight path of a tennis ball comprising an array of visible indicators in a defined sequence relative to one another and positioned on a forward facing panel of said console, A netting located between said tennis ball delivery machine and a player, A ball chute within said console for feeding of tennis balls, one at a time, to an impeller means for bounceless delivery of a single tennis ball from said ball chute to an awaiting tennis player, said all chute being further provided with gating means for control of passage of a tennis ball along said ball chute and activation means, associated with said gate, to open and close said gate, Timer means for coordinated ejection of a tennis ball with the last of said visible indicators, and Impeller means for delivery of a tennis ball from said console to an awaiting tennis player upon illumination of the last of said indicators within said indicator array.

10. The tennis training simulation system of claim 9, said netting having aperture means to allow ball delivery to said player.

11. A method for tennis training comprising:

providing an automated tennis ball delivery machine which includes a console having means for displaying the virtual flight path of a tennis ball comprising an array of visible indicators in a defined sequence relative to one another and positioned on a forward facing panel of said console, providing a ball chute within said console for feeding of tennis balls, one at a time, to an impeller means for bounceless delivery of a single tennis ball from said ball chute to an awaiting tennis player, said ball chute being further provided with gating means for control of passage of a tennis ball along said ball chute and activation means, associated with said gate, to open and close said gate, providing timer means for coordinated ejection of said tennis ball with the last of said visible indicators from said console, providing impeller means for delivery of a tennis ball from said console to an awaiting tennis player upon illumination of the last of said indicators within said indicator array, and, thereafter having said player striking or attempting to strike the said ball upon its ejection from said console.

* * * * *